US006139599A

United States Patent [19]

Takahashi et al.

[11] Patent Number: 6,139,599

[45] Date of Patent: Oct. 31, 2000

[54] ABRASION RESISTANT IRON BASE SINTERED ALLOY MATERIAL FOR VALVE SEAT AND VALVE SEAT MADE OF IRON BASE SINTERED ALLOY

[75] Inventors: Teruo Takahashi; Arata Kakiuchi; Kenichi Sato, all of Shimotsuga, Japan

[73] Assignee: Nippon Piston Ring Co., Ltd., Tochigi-ken, Japan

[21] Appl. No.: 09/378,995

[22] Filed: Aug. 23, 1999

[30] Foreign Application Priority Data

Dec. 28, 1998 [JP] Japan ..... 10-373913

[51] Int. Cl.[7] ..... B22F 5/00

[52] U.S. Cl. ..... 75/246; 75/243; 123/188.3

[58] Field of Search ..... 75/246, 243; 123/188.3

[56] References Cited

U.S. PATENT DOCUMENTS 4,233,073 11/1980 Takemura ..... 75/243
5,498,483 3/1996 Ito et al. ..... 428/552
5,759,227 6/1998 Takahashi et al. ..... 75/246
5,870,989 2/1999 Takahashi et al. ..... 123/188.3

FOREIGN PATENT DOCUMENTS 51-10393 4/1976 Japan .
9-53158 2/1997 Japan .

*Primary Examiner*—Ngoclan Mai
*Attorney, Agent, or Firm*—Oliff & Berridge, PLC

[57] ABSTRACT

A valve seat made of an iron base sintered alloy for internal combustion engines comprises of hard particles of hardness 700–1300 Hv dispersed by 3–20% by volume in a matrix phase comprising comprising of a 5–40% psarlite phase, a 20–60% fine carbide dispersed phase, and a 5–20% high alloy diffusd phase. The hard paricles are preferably selected from a group of Mo—Ni—Cr—Si—Co intermetallic compound particles, Cr—Mo—Co intermetallic compound particles, and Fe—Mo alloy particles. The iron base sinteed alloy is conpised of, by weight, C: 0.2–2.0%, Cr: 1.0–9.0%, Mo: 1.0–9.0%, Si: 0.1–1.0%, W: 1.0–50%, V: 0.2–3.0%, one or more Cu, Co and Ni of 0.5–10.0% in total, and the remainder substantial Fe.

18 Claims, 6 Drawing Sheets

(a) Sintered body No. 1

(b)

(a) Sintered body No. 2

(b)

(a) Sintered body No. 3

(b)

(a) Sintered body No. 10

(b)

(a) Sintered body No. 11

(b)

ABRASION RESISTANT IRON BASE SINTERED ALLOY MATERIAL FOR VALVE SEAT AND VALVE SEAT MADE OF IRON BASE SINTERED ALLOY

FIELD OF THE INVENTION

The present invention relates to a sintered alloy material and more particularly relates to an iron base sintered alloy material suitable for a valve seat for internal combustion engines.

DESCRIPTION OF THE PRIOR ART

A sintered alloy is produced by a method of preparing and mixing alloy powder, filling a metal mold with the mixed powder to compression-mold and sintering the molded powder at a predetermined temperature and atmosphere. A metal or an alloy which cannot be produced by an usual melting method can be easily produced by this method, and composite functions can be obtained whereby a part to which a unique function was imparted can be produced. Further, the sintered alloy is used for producing a porous material and a material of a low machinability and the like and for producing a machine component having a composite shape. Recently, this sintered alloy has been applied to an abrasion resistant valve seat for internal combustion engines.

Recently, in the car engines, demands for long life, high power, cleaning of exhaust gas, enhancement of fuel efficiency, and the like has been further increased, Thus, a valve seat for car engines are required to endure the use environment severer than in conventional cases, and the heat resistance and abrasion resistance of the valve seats have been required to be further improved.

For example, the Japanese examined patent publication No. Sho 51-13093 discloses an iron base sintered alloy material for a valve seat having high abrasion resistance, and at the same time having heat resistance and corrosion resistance as a sintered alloy material for a valve seat, even if gasoline containing no lead is used. This sintered alloy includes a large amount of C, Ni, Cr, Mo, Co, and W. In the pearlite matrix of the sintered alloy, special alloy particles of C—Cr—W—Co and ferromolibdenum particles are dispersed, while Co and Ni are diffused between these particles. As explained above, in this sintered alloy, addition of a large amount of particularly W and Co is required to improve the properties of the heat resistance, the abrasion resistance, the corrosion resistance and the like. Therefore, the valve seat made of the sintered alloy becomes expensive, resulting in cost problems.

Further, the Japanese unexamined patent publication No. Hei 9-53158 discloses a hard phase dispersed type iron base sintering alloy. This iron base sintered alloy is characterized in that, by weight, a 3–20% hard phase particles are dispersed in an iron base matrix consisting of, by weight, Ni: 3–15%, Mo: 3–15%, Cr: 0.5–5%, C: 0.5–1.2%, and the remainder Fe, said hard phase particles being one or more particles containing Cr: 50–57%, Mo: 18–22%, Co: 8–12%, C: 0.1–1.4%, Si: 0.8–1.3%, and the remainder Fe, or hard phase particles containing Cr: 27–33%, W: 22–28%, Co: 8–12%, C: 1.7–2.3%, Si: 1.0–2.0%, and the remainder Fe, or hard phase particles containing Mo: 60–70%, C: 0.01% or less, and the remainder Fe. In this iron base sintered alloy, addition of a large amount of Cr, Mo, Ni, Co, and W is required to improve heat resistance, abrasion resistance, corrosion resistance and the like. Therefore, the valve seat made of the sintered alloy becomes expensive, resulting in cost problems. Further, in this iron base sintered alloy, bad influences of the Ni and Co powder on human bodies remain as problems.

SUMMARY OF THE INVENTION

An object of the present invention is to advantageously solve the above-mentioned problems and therefore to provide an iron base sintered alloy material for a valve seat, which is inexpensive, safe on human bodies, and superior in the abrasion resistance, and a valve seat made of an iron base sintered alloy for internal combustion engines.

To attain the object the present inventors have examined variously, and found that by adding a fine carbide dispersed phase to the pearlite phase as the matrix phase of an iron base sintered alloy material, and dispersing hard particles in the matrix, the abrasion resistance of the sintered alloy material is remarkably increased without the addition of a large amount of alloy elements. The present invention was completed based on such a knowledge.

That is according to the present invention, there is provided an iron base sintered alloy material for valve seats, in the matrix phase of which hard particles were dispersed. The present invention is characterized in that said matrix phase comprises, by volume, a 5–40% pearlite phase, a 20–60% fine carbide dispersed phase, and a 5–20% high alloy diffused phase, said hard particles with hardness of 700–1300 Hv being dispersed by 3–20% by volume therein.

Further, according to the present invention, said hard particles preferably consist of one or more selected from a group of Mo—Ni—Cr—Si—Co intermetallic compound particles, Cr—Mo—Co intermetallic compound particles, and Fe—Mo alloy particles.

Further, according to the present invention, said matrix phase preferably contains solid lubricant particles of 0.1–10.0% by volume.

Further, according to the present invention, said solid lubricant particles preferably consist of one or more selected from a group of sulfide, fluoride and graphite.

Further, according to the present invention, sinter pores formed by sintering is preferably infiltrated with any one of Cu, Cu alloy, Pb, or Pb alloy or is preferably impregnated with phenol type resin.

Further, according to the present invention, there is provided an iron base sintered alloy material for a valve seat, in the matrix phase of which hard particles were disperesed. The present invention is characterized in that the composition of the matrix portion including said hard particles is composed of, by weight, C: 0.2–2.0%, Cr: 1.0–9.0%, Mo: 1.0–9.0%, Si: 0.1–1.0%, W: 1.0–5.0%, V: 0.2–3.0%, one or more of Cu, Co and Ni of 0.5–10.0% in total, and the remainder substantial Fe, and that said matrix phase comprises, by volume, a 5–40% pearlite phase, a 20–60% fine carbide dispersed phase, and a 5–20% high alloy diffused phase, said hard particles with hardness of 700–1300 Hv being dispersed by 3–20% by volume therein.

Further, according to the present invention, said carbide dispersed phase contains, by weight, C: 0.2–2.0%, Cr: 2.0–10.0%, Mo: 2.0–10.0%, W: 2.0–10.0%, V: 0.2–5.0%, and the remainder Fe and inevitable impurities.

Further, according to the present invention, said hard particles preferably consist of one or more selected from a group of Mo—Ni—Cr—Si—Co intermetallic compound particles, Cr—Mo—Co intermetallic compound particles, and Fe—Mo alloy particles.

Further, according to the present invention, said matrix phase preferably contains solid lubricant particles of 0.1–10.0% by volume.

Further, according to the present invention, said solid lubricant particles preferably consist of one or more selected from a group of sulfide, fluoride and graphite.

Further, according to the present invention, a sinter pores formed by sintering is preferably infiltrated with any one of Cu, Cu alloy, Pb, or Pb alloy or is preferably impregnated with phenol type resin.

Further, according to the present invention, there is provided a valve seat made of an iron base sintered alloy characterized by using said iron base sintered alloy material for a valve seat as a raw material.

Further, the present invention provides a method of producing an iron base sintered alloy material for a valve seat comprising a molding step for obtaining a green compact by filling a mold with raw powder, compressing and molding the powder, and a sintering step for obtaining a sintered body by heating the green compact at a temperature of 900–1200° C. in a protective atmosphere to sinter, and optionally comprising an infilitrating/impregnating step of subjecting said sintered body to an infiltrating or impregnating treatment.

In a method of producing an iron base sintered alloy material for a valve seat according to the present invention, said raw material powder is preferably produced by preparing and mixing, by weight, 20–80% of one or more alloy iron powder containing of by weight 20% or less of one or more selected from a group of C, Cr, Mo, Si, W, V, Cu, Co, and Ni and the remainder Fe and inevitable impurities; 3–20% of one or more hard particle powder selected from a group of Mo—Ni—Cr—Si—Co intermetallic compound particle powder, Cr—Mo—Co intermetallic compound particle powder, and Fe—Mo alloy particle powder; and optionally 0.1–10% of solid lubricant powder; with respect to the total amount of the alloy iron powder, hard particle powder and solid lubricant powder.

Further, in a method of producing an iron base sintered alloy material for a valve seat according to the present invention, said raw material powder may be produced by preparing and mixing, by weight, 20–80% of one or more alloy iron powder containing of, by weight, 20% or less of one or more selected from a group of C, Cr, Mo, Si, W, V, Cu, Co, and Ni and the remainder Fe and inevitable impurities; 10–30% of pure iron powder; 3–20% one or more of hard particle powder selected from a group of Mo—Ni—Cr—Si—Co intermetallic compound particle powder, Cr—Mo—Co intermetallic compound particle powder, and Fe—Mo alloy particle powder; and optionally 0.1–10% of solid lubricant powder; with respect to the total amount of the alloy iron powder, hard particle powder, solid lubricant powder, and pure iron powder.

Further, in a method of producing an iron base sintered alloy material for a valve seat according to the present invention, said raw material powder may be produced by preparing and mixing, by weight, 20–80% of one or more alloy iron powder containing of, by weight, 20% or less of one or more selected from a group of C, Cr, Mo, Si, W, V, Cu, Co, and Ni and the remainder Fe and inevitable impurities; the total amount of 0.5–10.0% of one or more alloy element selected from a group of Cr, Mo, Si, W, V, Cu, Co, and Ni; 3–20% of one or more hard particle powder selected from a group of Mo—Ni—Cr—Si—Co intermetallic compound particle powder, Cr—Mo—Co intermetallic compound particle powder, and Fe—Mo alloy particle powder; and optionally 0.1–10% of solid lubricant powder; with respect to the total amount of the alloy iron powder, hard particle powder, solid lubricant powder, and alloy element powder.

Further, in a method of producing an iron base sintered alloy material for a valve seat according to the present invention, said raw material powder may be produced by preparing and mixing, by weight, 20–80% of one or more alloy iron powder containing of, by weight, 20% or less of one or more selected from a group of C, Cr, Mo, Si, W, V, Cu, Co, and Ni and the remainder Fe and inevitable impurities; 10 to 80% of pure iron powder; the total amount of 0.5–10.0% of one or more alloy element selected from a group of Cr, Mo, Si, W, V, Cu, Co, and Ni; 3–20% of one or more hard particle powder selected from a group of Mo—Ni—Cr—Si—Co intermetallic compound particle powder, Cr—Mo—Co intermetallic compound particle powder, and Fe—Mo alloy particle powder; and optionally 0.1–10% of solid lubricant powder; with respect to the total amount of the alloy iron powder, hard particle powder, solid lubricant powder, pure iron powder, and alloy element powder.

Further, in a method of producing an iron base sintered alloy material for a valve seat according to the present invention, said infiltrating treatment is preferably a treatment using one selected from a group of Cu, Cu alloy, Pb and Pb alloy, as a filtrating material, and said impregnating treatment is preferably a treatment using a phenol type resin as a impregnating material.

Further, in a method of producing an iron base sintered alloy material for a valve seat according to the present invention, said solid lubricant is preferably one or two or more selected from a group of sulfide, fluoride, and graphite.

DESCRIPTION OF THE PREFERRED EMBODIMENTS

Figure 1:
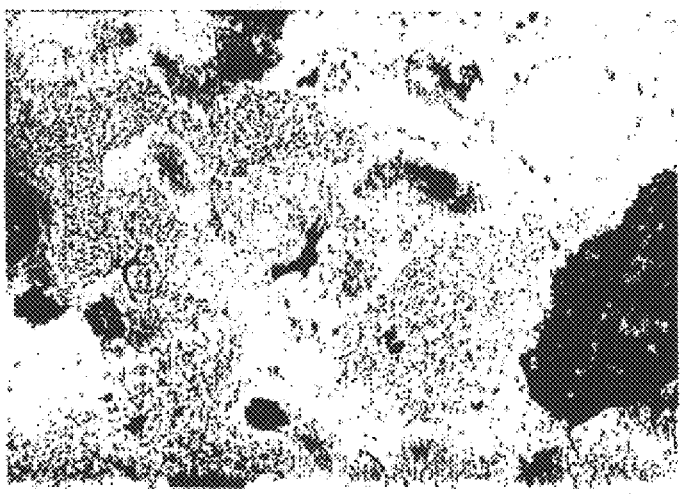
FIG. 1(*a*) is a photograph showing an optical microstructure of a sintered alloy material (sintered body No. 1) of an example of the present invention, and FIG. 1(*b*) is a sketch of FIG. 1(*a*).
Figure 1:
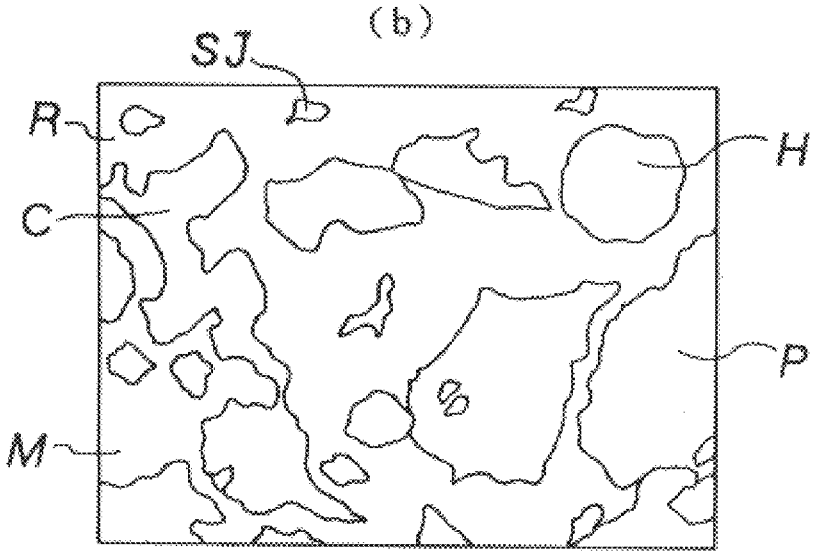

The iron base sintered alloy material according to the present invention comprises a matrix phase, hard particles dispersed in the matrix phase, and an optional solid lubricant particles dispersed in the matrix phase. Further, the matrix phase is composed of a pearlite phase, a fine carbide dispersed phase, a high alloy diffused phase diffused from the hard particles.

The hard particles dispersed in the matrix phase of an iron base sintered alloy material according to the present invention have particles with hardness in a range of 700–1300 Hv. If the hardness of the particles is less 700 Hv, the abrasion resistance is lowered. On the other hand, if it exceeds 1300 Hv, the toughness is lowered and the generation rate of a crack is increased.

In the present invention, the hard particles are peferably one or more selected from a group of Mo—Ni—Cr—Si—Co intermetallic compound particle powder, Cr—Mo—Co intermetallic compound particle powder, and Fe—Mo alloy particle powder. The Mo—Ni—Cr—Si—Co intermetallic compound particles contain, by weight, Mo: 20–30%, Ni: 5–20%, Cr: 10–35%, and Si: 1–5%, and the remainder is an intermetallic compound substantially consisting of Co. The Mo—Ni—Cr—Si—Co intermetallic compound particles are preferably added to the raw material powder as alloy powder. The alloy powder having the above-mentioned composition is increased in sintering diffusibility, whereby the strength and toughness of a sintered alloy material are increased. Further, the Fe—Mo alloy particles contain, by weight, Mo: 50–70% and the remainder is particles substantially consisting of Fe. The Fe—Mo alloy particles are preferably added to the raw material powder as alloy powder. Further, the Cr—Mo—Co intermetallic compound particles contain, by weight, Cr: 5.0–15.0%, and Mo: 20.0–40.0%, and the remainder is an intermetallic compound substantially consisting of Co. The Cr—Mo—Co intermetallic compound particles are preferably added to the raw material powder as alloy powder.

Also, in the present invention, the particle diameter of the hard particles is desirably 150 $\mu$m or less and 10 $\mu$m or more. If the particle diameter is less 10 $\mu$m, hard particle components are excessively diffused into the matrix phase during sintering, whereby the hardness is lowered. On the other hand, if the particle diameter exceeds 150 $\mu$m, the machinability is lowered and opposite aggressibility is increased.

In the iron base sintered alloy material according to the present invention, the hard particles are dispersed by 3–20% by volume ratio. If the hard particles are less 3% by volume ratio, the amount of the hard particles is small, whereby the abrasion resistance is lowered. On the other hand, if it exceeds 20%, the strength of the material is lowered and opposite aggressibility is increased.

Further, in the iron base sintered alloy material according to the present invention, solid lubricant particles may be dispersed into the matrix phase. The solid lubricant particles are preferably of one or more selected from sulfide, fluoride and graphite. Such sulfide is preferably of MnS, $MoS_2$, or $W_2S$, and the fluoride is preferably of $CaF_2$ or LiF. Dispersion of the solid lubricant particles into the matrix enhances the machinability and the abrasion resistance, and therefore decreases opposite aggressibility.

The solid lubricant particles are preferably dispersed by total amount 1–10%, by weight, with respect to the total amount of the matrix phase, the hard particles and the solid lubricant particles. If the amount of the solid lubricant particles is less 0.1%, it is small and the lubricity and the machinability are deteriorated, and the generation of coagulation is accelerated, and at the same time the abrasion resistance is lowered. On the other hand, if the amount of the solid lubricant particles exceeds 10.0%, the powder compressibility, sinter diffusibility and strength are lowered.

Also, the particle diameter of the solid lubricant particles is preferably 2–50 $\mu$m, If the particle diameter of the solid lubricant particles is less 2 $\mu$m, the above-mentioned effects are not expected. On the other hand, if it exceeds 50 $\mu$m, sinterability and powder compressibility are badly influenced.

The composition of the matrix portion including the matrix phase, and the hard particles dispersed into the matrix phase is preferably consisting of, by weight, C: 0.2–2.0%, Cr: 1.0–9.0%, Mo: 1.0–9.0%, Si: 0.1–1.0%, W: 1.0–5.0%, V: 0.2–3.0%, and total amount 0.5–10.0% of one or more selected from a group of Cu, Co and Ni, and the remainder being Fe substantially.

We will now explain desirable contents of individual alloy elements.

C: 0.2–2.0%

C is an element which is solid-soluble in a matrix phase and increases hardness of the matrix phase, and which is combined with other alloy elements to form carbide thereby increasing hardness of the matrix phase and enhancing abrasion resistance. However, if C is less 0.2%, a desirable hardness cannot be obtained and the abrasion resistance is lowered. On the other hand, if C exceeds 2.0%, carbide is enlarged and toughness is deteriorated. Therefore, C is desirably limited to a range of 0.2–2.0%.

Cr: 1.0–9.0%

Cr is contained in a matrix phase and hard particles and is an element which enhances hardness, abrasion resistance and heat resistance. If the Cr content exceeds 9.0%, the amount of hard particles is excessive or the hardness of the matrix phase is extremely increased, thereby increasing opposite aggressibility. On the other hand, if Cr content is less 1.0%, the amount of hard particles is short, which imparts bad influence to the abrasion resistance. Therefore, Cr is preferably 1.0–9.0%.

Mo: 1.0–9.0%

Mo strengthens a matrix phase and is contained in hard particles thereby enhancing abrasion resistance. However, Mo exceeds 9.0%, the amount of hard particles is excessive or the hardness of the matrix phase is extremely increased, thereby increasing opposite aggressibility. On the other hand, if Mo is less 1.0%, the amount of hard particles is short and hardness is lowered, which is apt to impart bad influence to the abrasion resistance. Therefore, Mo is preferably 1.0–9.0%.

Si: 0.1–1.0%

Si is mainly contained in hard particles and is an element which enhances abrasion resistance. If Si is less 0.1%, an effect of enhancing abrasion resistance is not remarkable. On the other hand, if Si exceeds 1.0%, hardness is excessively increased and opposite aggressibility is increased. Therefore, Si is desirably limited to a range of 0.1–1.0%.

W: 1.0–5.0%

W is an element which forms carbide, strengthens a matrix phase, and enhances hardness and abrasion resistance. However, if W is less 1.0%, an effect of enhancing abrasion resistance is not remarkable. On the other hand, if Si exceeds 5.0%, hardness is excessively increased and opposite aggressibility is increased. Therefore, W is desirably limited to a range of 1.0–5.0%.

V: 0.2–3.0%

V is an element which forms carbide, strengthens a matrix phase, and enhances hardness and abrasion resistance. However, if V is less 0.2%, an effect of enhancing abrasion resistance is not remarkable. On the other hand, if Si exceeds 3.0%, hardness is excessively increased and opposite aggressibility is increased. Therefore, V is desirably limited to a range of 0.2–3.0%.

Total amount 0.5–10.0% of one or more selected from a group of Cu, Co, and Ni.

Each of Cu, Co, and Ni strengthens a matrix phase and enhances hardness and abrasion resistance. However, if the total amount of Cu, Co, and Ni is less 0.5%, their effects are insufficient. On the other hand, if an excessive addition of the elements increases opposite aggressility. Therefore, the total amount of Cu, Co, and Ni was limited to 0.5–10.0%. A hard particles or solid lubricant particles dispersed matrix phase has a structure composed of a 5–40% pearlite phase, a 20–60% fine carbide dispersed phase, and a 5–20% high alloy diffused phase formed by the diffusion of alloy elements from the hard particles, by volume with respect to all of a sintered alloy material.

If the pearlite phase in the matrix phase structure is less 5% by volume, hardness of the matrix is increased and therefore machinability is lowered. If it exceeds 40%, hardness of the matrix is lowered and therefore abrasion resistance and the heat resistance are lowered, An iron base sintered alloy material according to the present invention, is characterized in that it has a carbide dispersed phase in addition to a pearlite phase as the matrix phase structure. The carbide dispersed phase is a phase in which fine carbide preferably having a particle diameter of 1–10 $\mu$m is dispersed. Abrasion resistance of an iron base sintered alloy material can be enhanced by the dispersion of the fine carbide without addition of a large amount of expensive alloy elements such as Co, W and the like. If the particle diameter of carbide dispersed in a phase is less 1 $\mu$m, the amount of carbide is small and therefore abrasion resistance is lowered. On the other hand, if the particle diameter exceeds 10 $\mu$m, opposit aggressibility is increased. A carbide dispersed phase is contained in the matrix phase by 20–60% by volume. If the carbide dispersed phase is less 20% by volume, heat resistance and abrasion resistance are lowered. On the other hand it exceeds 60%, strength, toughness and machinability are lowered.

The composition of the carbide dispersed phase is preferably consisting of, by weight, C: 0.2–2.0%, Cr: 2.0–10.0%, Mo: 2.0–10.0%, W: 2.0–10.0%, and V: 0.2–5.0% and the remainder Fe and inevitable impurities. To form a carbide dispersed phase having such a compsition, alloy iron powder having the above-mentioned composition is preferably added to a raw material powder. For example, SKH 51 powder which contains a large amount of carbide forming elements such as V, W, Mo and the like (typical composition:0.9% C-4% Cr-5% Mo-6% W-2% V-the remainder Fe, by weight), SKH 57 powder, and SKD 11 powder are preferably used.

A high alloy diffused phase is formed around hard particles by diffusion of alloy elements therefrom. This high alloy diffused phase contributes to heat resiatance, abrasion resistance, and corrosion resistance, and therefore, enhances the properties of the iron base sintered alloy material. If the high alloy diffused phase is less 5% by volume, enhancement of the above-mentioned properties is small. On the other hand, it exceeds 20%, machinability is deteriorated.

One example of a structure of an iron base sintered alloy material according to the present invention is shown in FIGS. 1(*a*) and 1(*b*).

Particularly, FIG. 1(*a*) is an optical microstructure, and FIG. 1(*b*) is a sketch of FIG. 1(*a*). The matrix portion is composed of a matrix phase (M), hard particles (H, Mo—Cr—Ni—Si—Co intermetallic compound particles) and solid lubricant particles (SJ, MnS) dispersed in the matrix phase respectively. The composition of the matrix phase is composed of pearlite (P), a carbide dispersed phase (C, C—Cr—Mo—W—V series composition), and a high alloy diffused phase (R). This H is Mo—Cr—Ni—Si—Co intermetallic compound particles, SJ is MnS, and C is formed by using C—Cr—Mo—W—V series alloy powder.

An iron base sintered alloy material according to the present invention may include pores of 10% or less by volume. If the pore percentage exceeds 10.0%, high-temperature strength and thermal conductivity are lowered and at the same time falling resistance is also lowered.

To produce an iron base sintered alloy material according to the present invention, as a raw material powder, by weight, 20–80% pure iron powder, 0.5–10.0% total alloy element powder of one or more selected from a group of Cr, Mo, Si, W, V, Cu, Co and Ni, 3–20% hard particle powder of one or more selected from a group of Mo—Ni—Cr—Si—Co intermetallic compound particle powder, Cr—Mo—Co intermetallic compound particle powder, and Fe—Mo alloy particle powder, and 0.1–10% solid lubricant powder are preferably prepared and mixed, with respect to the total amount of the pure iron powder, the alloy element powder, the hard particle powder, and the solid lubricant powder, so that the composition of the above-mentioned matrix portion is obtained. Alternatively, as the lubricant, zinc stearate or the like may be prepared. Further, as the solid lubricant powder, one powder selected from sulfide, fluoride and graphite is preferably used, and two or more powder selected therefrom are preferably used in a mixed state. As the sulfide powder, powder of for example, MnS, $MoS_2$, or $W_2S$ is used. Also, as the fluoride powder, powder of for example, $CaF_2$ or LiF is used.

Alloy iron powder, pure iron powder, alloy element powder, hard particle powder and solid lubricant powder are prepared and mixed so as to form the composition of the above-mentioned matrix portion, whereby raw material powder is produced.

Combination of pure iron powder, alloy element powder and alloy iron powder is preferably as follows. Namely, it may be formed by total 20–80% of one or more alloy iron powder containing of, by weight, 20% or less of one or more selected from a group of C, Cr, Mo, Si, W, V, Cu, Co, and Ni, and the remainder Fe and inevitable impurities; or by total 20–80% of one or more alloy iron powder containing of, by weight, 20% or less of one or more selected from a group of C, Cr, Mo, Si, W, V, Cu, Co, and Ni, and the remainder Fe and inevitable impurities, and 10.0–80.0% pure iron powder; or by total 20–80% of one or more alloy iron powder containing of, by weight, 20% or less of one or more selected from a group of C, Cr, Mo, Si, W, V, Cu, Co, and Ni, and the remainder Fe and inevitable impurities, and total 0.5–10.0% of one or more selected from a group of Cr, Mo, Si, W, V, Cu, Co, and Ni, and the remainder Fe and inevitable impurities; or by total 20–80% of one or more alloy iron powder containing of, by weight, 20% or less of one or more selected from a group of C, Cr, Mo, Si, W, V, Cu, Co, and Ni, and the remainder Fe and inevitable impurities, 10.0–80.0% pure iron powder, and total 0.5–10.0% of one or more selected from a group of Cr, Mo, Si, W, V, Cu, Co, and Ni, and the remainder Fe and inevitable impurities.

As the hard particle powder, 3–20% of one selected from a group of Mo—Ni—Cr—Si—Co intermetallic compound particle powder, Cr—Mo—Co intermetallic compound particle powder, and Fe—Mo alloy particle powder are preferable with respect to the total amount of the raw material powder. Further, 0.1–10.0% solid lubricant particle powder is preferably prepared.

An iron base sintered alloy material for a valve seat is produced by a method comprising a molding step of filling a metal mold with these mixed powder as raw material powder, compressing and molding the powder to obtain green compact, and a sintering step of heating the green compact at a temperature in a range of 1000–1200° C. in a protective atmospher, to sinter so that a sintered body is obtained, and optionally an infiltrating/impregnating step of subjecting to an infiltrating or impregnating treatment.

If the sintering step is performed at less 1000° C., sinter diffusion is short, so that the formation of a matrix is insufficient. On the other hand, if the temperature exceeds 1200° C., excessive diffusion of the matrix is generated and abrasion resiatance is deteriorated. A sintering atmosphere uses a protective atmosphere such as preferable $NH_3$, a mixed gas of $N_2$ and $H_2$ or the like.

The infiltrating/impregnating step is optionally performed to seal sinter pores. The sealing treatment is performed by charging a low melting point metal such as Cu or a Cu alloy, or Pb or a Pb alloy or the like, to a sintered body and heating it, or by impregnating a sintered body with a phenol series resin.

The obtained sintered body is subjected to cutting and grinding so that a valve seat having a desired size and shape is produced.

EXAMPLE

Iron powder, alloy iron powder, alloy element powder, hard particle powder and optionally solid lubricant powder were prepared as listed in Table 1 and mixed to obtain mixed powder. The preparation amounts are listed by weight % for all amounts of the mixed powder. The used alloy iron powder is, by weight, (A) 1% Cr-0.3% Mo-the remainder Fe alloy iron powder, and (B) 0.9% C-4% Cr-5% Mo-6% W-2% V-the remainder Fe alloy iron powder (SKH 51 powder). Further, as the hard particle powder, (a) 25% Mo-10% Ni-25% Cr-2% Si-the remainder Co intermetallic compound particle powder. (b) 60% Mo-the remainder Fe alloy particle, (c) 10% Cr-30% Mo-the remainder Co intermetallic compound particle, and (d) 2% C-20% W-10% Co-the remainder Cr alloy powder, by weight, were used. Also, as solid lubricant powder, ① MnS. and ② $CaF_2$ were used.

A mold was filled with these mixed powder. After that, the mixed powder was compressed and molded by a molding press to form green compact.

Then, the green compact was sintered for 15–45 min in a reduction atmospher ($NH_3$ gas) at a temperature of 1000–1200° C., thereby to obtain sintered bodies. Alternatively, some of the sintered bodies were subjected to an infiltrating treatment while heating at a temperature of 500° C. them together with infiltration agent (lead).

The compositions and structure ratios of the matrix portion of the obtained sintered bodies will be shown in Table 2.

Figure 2:
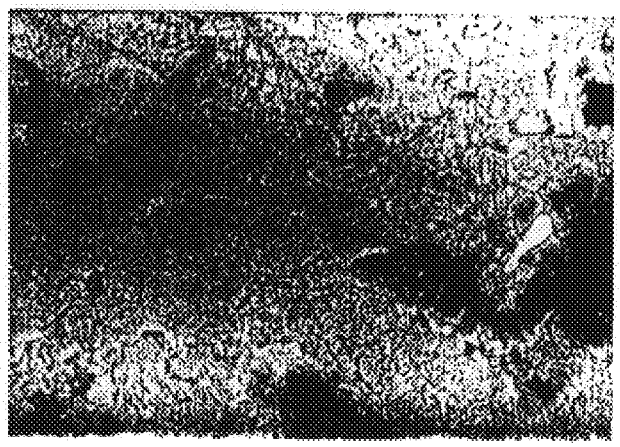
FIG. 2(*a*) is a photograph showing an optical microstructure of a sintered alloy material (sintered body No. 2) of an example of the present invention, and FIG. 2(*b*) is a sketch of FIG. 2(*a*).
Figure 2:
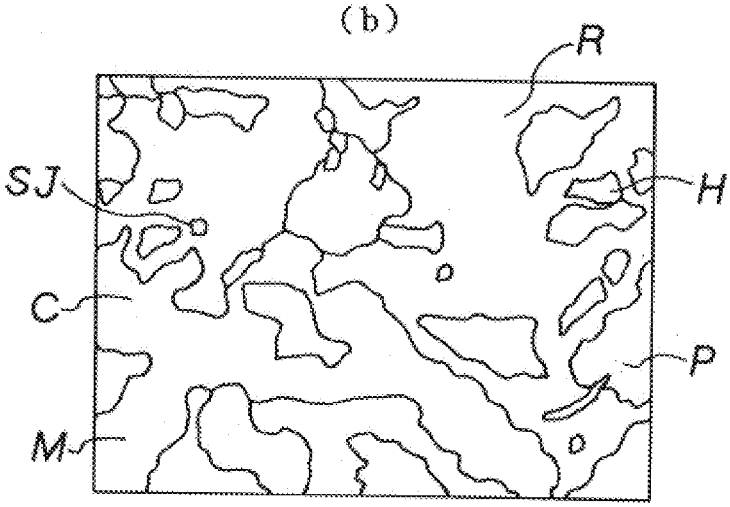
Figure 3:
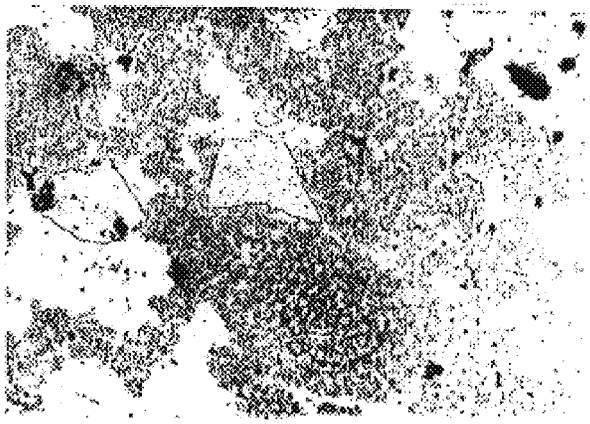
FIG. 3(*a*) is a photograph showing an optical microstructure of a sintered alloy material (sintered body No. 3) of an example of the present invention, and FIG. 3(*b*) is a sketch of FIG. 3(*a*).
Figure 3:
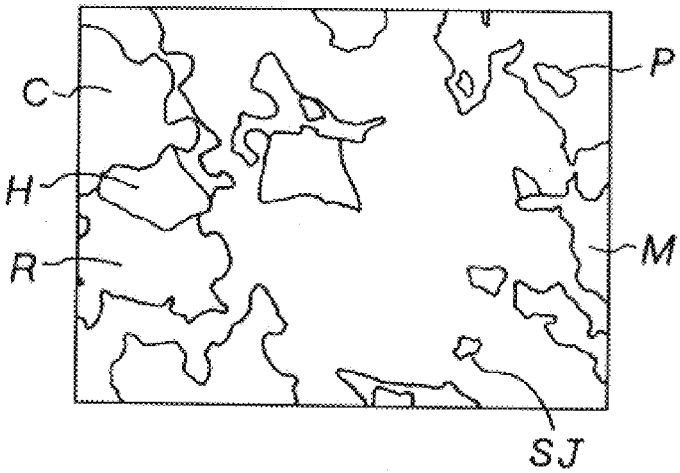
Figure 4:
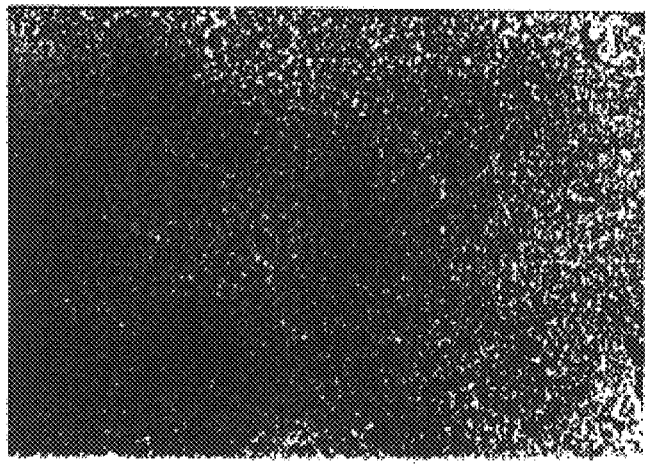
FIG. 4(*a*) is a photograph showing an optical microstructure of a sintered alloy material (sintered body No. 10) of a comparative example, and FIG. 4(*b*) is a sketch of FIG. 4(*a*).
Figure 4:
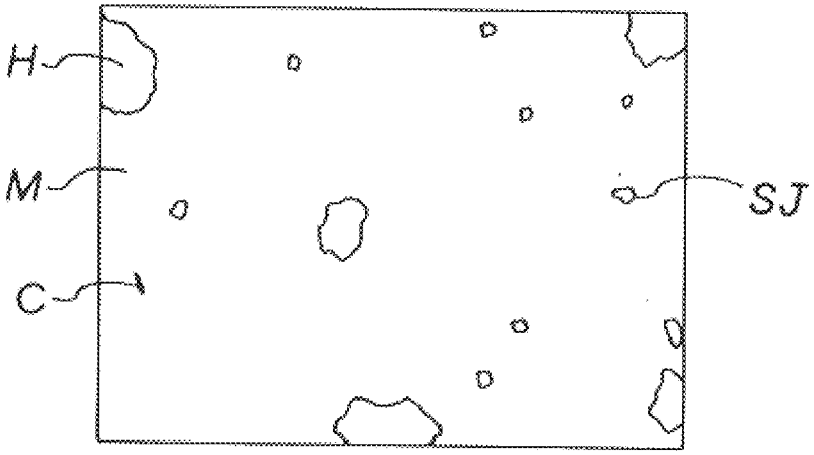
Figure 5:
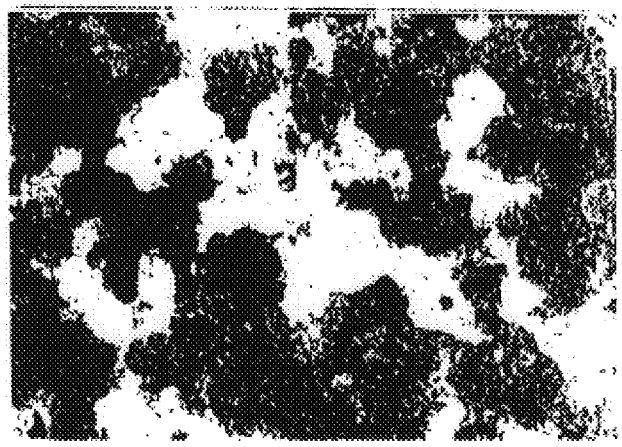
FIG. 5(*a*) is a photograph showing an optical microstructure of a sintered alloy material (sintered body No. 11) of a comparative example, and FIG. 5(*b*) is a sketch of FIG. 5(*a*).
Figure 5:
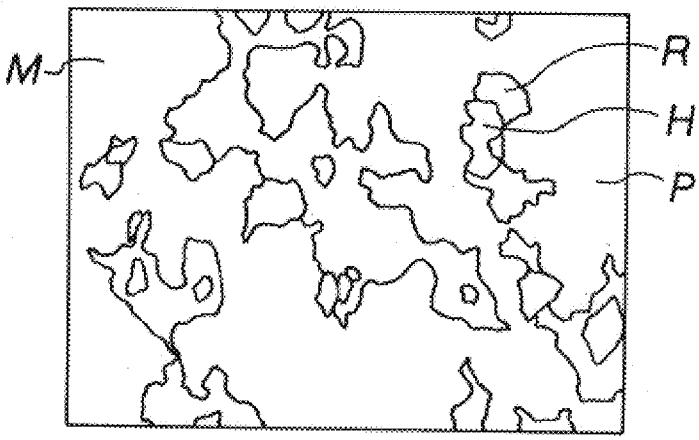

Optical micrographs of metal srtucture of sintered bodies No. 2, No. 3, No. 10 and No. 11 are shown in FIGS. 2(*a*), 3(*a*), 4(*a*), and 5(*a*), respectively. FIGS. 2(*b*), 3(*b*), 4(*b*), and 5(*b*) are the respective sketches of the above-mentioned FIGS. 2(*a*) to 5(*a*). In these sketches, M denotes a matrix phase, P a pearlite phase, R a high alloy diffused phase, C a carbide dispersed phase, H hard particles, and SJ solid lubricant particles. The structure of the matrix is a pearlite (P) phase.

Then, these sintered bodies were worked to produce valve seats (shape: ϕ41.4×ϕ38.8×7.0 mm), and the valve seats were subjected to a unit rig abrasion test described below.

(1) Single Body Rig Abrasion Test (Abrasion Resistance Test)

Figure 6:
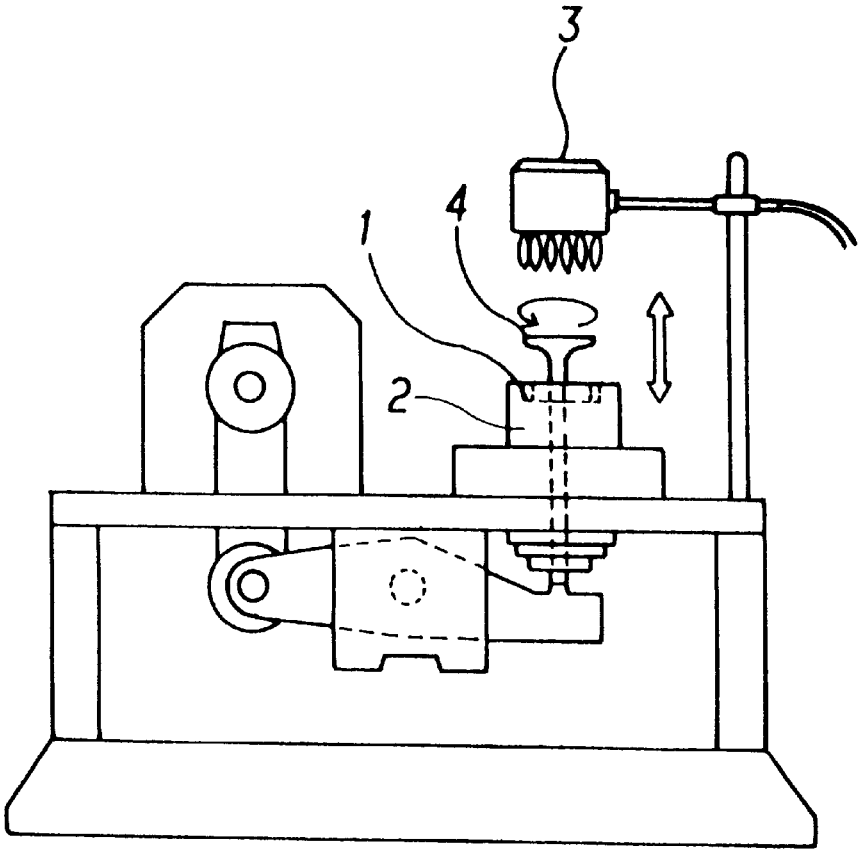
FIG. 6 is an explanatory schematic view of a unit rig abrasion tester.

Abrasion resistances were examined by means of a single body rig abrasion tester shown in FIG. 6. In the single body rig test, a valve seat 1 was press-fitted in a device 2 corresponding to a cylinder head. After that, while heating a valve 4 and the valve seat 1 by a heat source (LPG+Ar) attached to the tester, the valve 4 was moved up and down repeatedly, and abrasion quantities of both valve seats and valves were measured by valve sinking quantities. The test conditions are as follows.

test temperature: 400° C. (seat surface)

test time: 9.0 hours cam rotary speed: 3000 rpm valve rotary speed: 20 rpm spring load: 35 kgf (at setting)

material valve: SUH 3

Table 1

Table 2

Abrasion amounts of valve seats produced by sintered bodies No. 1 to No. 9 of examples of the present invention were 10 to 17 μm. Also, abrasion amounts of opposits (valves) were 5 to 15 μm. Abrasion amounts of valve seats produced by sintered bodies No. 10 and No. 11 of comparative examples departed from the scope of the present invention were 28 to 51 μm. Also, abrasion amounts of opposites (valves) were 20 to 51 μm. The examples of the present invention have less abrasion amounts as compared to those of the comparative examples. And, abrasion resistance of the examples of the present invention is further enhanced and opposite aggressibility is lowered.

According to the present invention, sintered alloy materials which are inexpensive, safe to human bodies and superior to abrasion resistance can be obtained. Further, the sintered alloy materials exhibit a superior endurance as car valve seats used in sever driving. Therefore, the present invention provides considerable effects to the industry.

Having now fully described the present invention, it will be understood for one of ordinary skill in the art that many changes and modifications can be made without departing from the spirit or scope of the invention as set forth herein.

The entire disclosure of Japanese patent publications described as prior arts are incorporated here by reference in its entirety.

TABLE 1

| Sintered body No. | Preparation amount (wt %) | | | | | | | | | | |
|---|---|---|---|---|---|---|---|---|---|---|---|
| | Iron powder | Alloy Iron powder | | Alloy element powder | Total amount | Hard particle powder | | Solid lubmcant particle powder | | Impregnation agent | |
| | | Type | wt % | | | Type | wt % | Type | wt % | Type | wt % |
| 1 | 47 | B | 40 | Cu:2.0 | 2.0 | a | 10.0 | ① | 1.0 | — | — |
| 2 | 47 | B | 40 | Cu:2.0 | 2.0 | b | 10.0 | ① | 1.0 | — | — |
| 3 | 27 | B | 60 | Cu:7.0 | 7.0 | b | 5.0 | ① | 1.0 | — | — |
| 4 | 57 | B | 30 | Cu:2.0 | 2.0 | b | 10.0 | ① | 1.0 | — | — |
| 5 | 63 | B | 20 | Cu:2.0 | 2.0 | c | 10.0 | ② | 5.0 | — | — |

TABLE 1-continued

| Sintered body No. | Preparation amount (wt %) Iron powder | Alloy Iron powder Type | wt % | Alloy element powder | Total amount | Hard particle powder Type | wt % | Solid lubmcant particle powder Type | wt % | Impregnation agent Type | wt % |
|---|---|---|---|---|---|---|---|---|---|---|---|
| 6 | — | A | 47 | Cu:2.0 | 2.0 | b | 10.0 | — | — | Pb | 1.0 |
| | | B | 40 | | | | | | | | |
| 7 | 60 | B | 20 | Cu:7.0 | 7.0 | b | 10.0 | ② | 3.0 | — | — |
| 8 | — | A | 46 | Cu:2.0 | 2.0 | a | 10.0 | ① | 1.0 | Pb | 1.0 |
| | | B | 40 | | | | | | | | |
| 9 | — | A | 32 | — | — | b | 5.0 | ① | 1.0 | Pb | 2.0 |
| | | B | 60 | | | | | | | | |
| 10 | — | B | 89.5 | — | — | a | 10.0 | ① | 0.5 | — | — |
| 11 | 75 | — | — | Co:6.0, Ni:4.0 | 10.0 | d | 15.0 | — | — | — | — |

* Alloy iron powder
A: Fe-1.0% Cr-0.3% Mo
B: SKH51 Powder
** Hard particles
a: 25% Mo-10% Ni-25% Cr-2% Si-Co Intermetallic compound
b: 60% Mo- Fe Alloy
c: 10% Cr-30% Mo-Co Intermetallic compound
d: 2% C-20% W-10% Co-Cr Alloy
Solid lubricant
① MnS
② $CaF_2$

TABLE 2

| Sintered body No. | Sintered body: Composition of matrix portion Cr | Mo | Si | W | V | Co, Ni, Cu | Matrix pase structure: Pearlite phase vol. % | High alloy diffused phase vol. % | Matrix phase structure: Particle diameter μm | Vol. % |
|---|---|---|---|---|---|---|---|---|---|---|
| 1 | 4.0 | 4.7 | 0.3 | 2.3 | 0.8 | Co:4.0, Ni:1.0, Cu:2.0 | 30 | 19 | 3 | 40 |
| 2 | 1.6 | 7.9 | 0.1 | 2.3 | 0.8 | Cu:2.0 | 35 | 14 | 3 | 40 |
| 3 | 2.5 | 5.9 | 0.2 | 3.5 | 1.2 | Cu:7.0 | 20 | 14 | 4 | 60 |
| 4 | 1.2 | 7.5 | 0.1 | 1.7 | 0.6 | Cu:2.0 | 40 | 19 | 3 | 30 |
| 5 | 1.7 | 3.8 | 0.3 | 1.2 | 0.4 | Cu:2.0, Co:6.0 | 29 | 16 | 3 | 35 |
| 6 | 3.0 | 8.0 | 0.1 | 2.3 | 0.9 | Cu:2.0 | 35 | 14 | 3 | 40 |
| 7 | 0.8 | 7.0 | 0.06 | 1.2 | 0.4 | Cu:7.0 | 37 | 15 | 3 | 35 |
| 8 | 5.5 | 4.5 | 0.3 | 2.3 | 0.9 | Co:4.0, Ni:1.0, Cu:2.0 | 30 | 18 | 3 | 40 |
| 9 | 3.5 | 6.0 | 0.2 | 3.5 | 1.3 | — | 35 | 17 | 3 | 40 |
| 10 | 3.7 | 10.4 | 0.3 | 5.2 | 1.8 | — | 0 | 0 | 5 | 89.5 |
| 11 | 9.2 | — | — | 2.8 | — | Co:7.5, Ni:4.0 | 65 | 20 | — | — |

| Sintered body No. | Hard particle: Particle diameter μm | Hardness Hv | Vol. % | Solid lubricant particle: Particle diameter μm | Vol. % | Impregnation agent Vol. % | Pore % Vol. % | Single Body rig test: Abrasion guantilies Sheet | Valve | Remarks |
|---|---|---|---|---|---|---|---|---|---|---|
| 1 | 80 | 1000 | 10 | 15 | 1 | — | 5 | 13 | 7 | Example invention |
| 2 | 70 | 1000 | 10 | 15 | 1 | — | 6 | 15 | 9 | Example invention |
| 3 | 70 | 1000 | 5 | 15 | 1 | — | 4 | 12 | 13 | Example invention |
| 4 | 70 | 1000 | 10 | 15 | 1 | — | 3 | 17 | 7 | Example invention |
| 5 | 90 | 750 | 10 | 10 | 5 | — | 3 | 10 | 6 | Example invention |
| 6 | 70 | 1000 | 10 | — | — | 1 | 2 | 15 | 5 | Example invention |
| 7 | 70 | 1000 | 10 | 10 | 3 | — | 3 | 13 | 15 | Example invention |
| 8 | 80 | 1000 | 10 | 15 | 1 | 1 | 2 | 15 | 6 | Example invention |
| 9 | 70 | 1000 | 5 | 15 | 1 | 2 | 1 | 15 | 10 | Example invention |
| 10 | 80 | 1000 | 10 | 15 | 0.5 | — | 11 | 28 | 51 | Comparative example |
| 11 | 70 | 1300 | 15 | — | — | — | 10 | 50 | 20 | Comparative example |

What is claimed is:

1. An iron base sintered alloy material for a valve seat, in the matrix phase of which hard particles were dispersed, wherein said matrix phase comprises, by volume, a 5–40% pearlite phase, a 20–60% fine carbide dispersed phase, and a 5–20% high alloy diffused phase, said hard particles with hardness of 700–1300 Hv being dispersed by 3–20% by volume therein.

2. An iron base sintered alloy material for a valve seat, in the matrix phase of which hard particles were dispersed, wherein the composition of the matrix portion including said hard particles is composed of, by weight, C: 0.2–2.0%, Cr: 1.0–9.0%, Mo: 1.0–9.0%, Si: 0.1–1.0%, W: 1.0–5.0%, V: 0.2–3.0%, one or more of Cu, Co and Ni of 0.5–10.0% in total, and the remainder substantial Fe, and wherein said matrix phase includes, by volume, a 5–40% pearlite phase, a 20–60% fine carbide dispersed phase, and a 5–20% high alloy diffused phase, said hard particles with hardness of Hv 700–1300 being dispersed by 3–20% by volume therein.

3. An iron base sintered alloy material for a valve seat, according to claim 2, chracterized wherein said carbide dispersed phase contains by weight C: 0.2–2.0%, Cr: 2.0–10.0%, Mo: 2.0–10.0%, W: 2.0–10.0%, V: 0.2–5.0%, and the remainder of Fe and inevitable impurities.

4. An iron base sintered alloy material for a valve seat, according to claim 1, wherein said hard particles consist of one or more selected from a group of Mo—Ni—Cr—Si—Co intermetallic compound particles, Cr—Mo—Co intermetallic compound particles, and Fe—Mo alloy particles.

5. An iron base sintered alloy material for a valve seat, according to claim 1, wherein said matrix phase further contains solid lubricant particles of 0.1–10.0% by volume ratio.

6. An iron base sintered alloy material for a valve seat, according to claim 5, wherein said solid lubricant particles consist of one or two or more selected from a group of sulfide, fluoride and graphite.

7. An iron base sintered alloy material for a valve seat, according to claim 1, wherein a sinter pores formed by sintering is infiltrated with any one of Cu, Cu alloy, Pb, or Pb alloy, or is impregnated with phenol type resin.

8. A valve seat made of an iron base sintered alloy wherein characterized said iron base sintered alloy material for a valve seat according to claim 1 is used as a raw material.

9. An iron base sintered alloy material for a valve seat, according to claim 2, wherein said hard particles consist of one or more selected forma group of Mo—Ni—Cr—Si—Co intermetallic compound particles, Cr—Mo—Co intermetallic compound particles, and Fe—Mo alloy particles.

10. An iron base sintered alloy material for a valve seat, according to claim 2, wherein said matrix phase further contains solid lubricant particles of 0.1–10.0% by volume ratio.

11. An iron base sintered alloy material for a valve seat, according to claim 3, wherein said matrix phase further contains solid lubricant particles of 0.1–10.0% by volume ratio.

12. An iron base sintered alloy material for a valve seat, according to claim 4, wherein said matrix phase further contains solid lubricant particles of 0.1–10.0% by volume ratio.

13. An iron base sintered alloy material for a valve seat, according to claim 2, wherein a sinter pores formed by sintering is infiltrated with any one of Cu, Cu alloy, Pb, or Pb alloy, or is impregnated with phenol type resin.

14. An iron base sintered alloy material for a valve seat, according to claim 3, wherein a sinter pores formed by sintering is infiltrated with any one of Cu, Cu alloy, Pb, or Pb alloy, or is impregnated with phenol type resin.

15. An iron base sintered alloy material for a valve seat, according to claim 4, wherein a sinter pores formed by sintering is infiltrated with any one of Cu, Cu alloy, Pb, or Pb alloy, or is impregnated with phenol type resin.

16. An iron base sintered alloy material for a valve seat, according to claim 5, wherein a sinter pores formed by sintering is infiltrated with any one of Cu, Cu alloy, Pb, or Pb alloy, or is impregnated with phenol type resin.

17. An iron base sintered alloy material for a valve seat, according to claim 6, wherein a sinter pores formed by sintering is infiltrated with any one of Cu, Cu alloy, Pb, or Pb alloy, or is impregnated with phenol type resin.

18. A valve seat made of an iron base sintered alloy wherein characterized said iron base sintered alloy material for a valve seat according to claim 7 is used as a raw material.

* * * * *